United States Patent [19]

Varunki

[11] Patent Number: 4,827,971

[45] Date of Patent: May 9, 1989

[54] CONSTANT AIR FLOW RATE VALVE, AND PROCEDURE FOR CONTROLLING A CONSTANT AIR FLOW RATE VALVE

[75] Inventor: Markku Varunki, Helsinki, Finland

[73] Assignee: Halton Oy, Finland

[21] Appl. No.: 53,880

[22] PCT Filed: Sep. 25, 1986

[86] PCT No.: PCT/FI86/00100

§ 371 Date: May 1, 1987

§ 102(e) Date: May 1, 1987

[87] PCT Pub. No.: WO87/02120

PCT Pub. Date: Apr. 9, 1987

[30] Foreign Application Priority Data

Sep. 27, 1985 [FI] Finland ..... 853751

[51] Int. Cl.[4] ..... F16K 31/365; G05D 7/01

[52] U.S. Cl. ..... 137/503; 137/504

[58] Field of Search ..... 137/498, 501, 504, 517, 137/8, 503; 251/61.1; 138/46

[56] References Cited

U.S. PATENT DOCUMENTS

| | | | |
|---|---|---|---|
| 2,740,418 | 4/1956 | Pankratz | 137/517 X |
| 2,925,826 | 2/1960 | Streeter | 137/517 |
| 3,022,977 | 2/1962 | Jones | 251/61.1 |
| 3,255,963 | 6/1966 | Gorchev et al. | 138/46 X |
| 3,718,160 | 2/1973 | Jardinier et al. | 138/46 |
| 3,958,605 | 5/1976 | Nishizu et al. | 138/46 |

FOREIGN PATENT DOCUMENTS

| | | | |
|---|---|---|---|
| 2649307 | 5/1978 | Fed. Rep. of Germany . | |
| 2801605 | 7/1978 | Fed. Rep. of Germany | 251/61.1 |
| 2019862 | 10/1979 | Fed. Rep. of Germany . | |
| 2852579 | 8/1984 | Fed. Rep. of Germany . | |
| 62414 | 8/1982 | Finland . | |
| 2198101 | 3/1974 | France . | |
| 635027 | 2/1962 | Italy | 137/498 |
| 362490 | 2/1973 | Sweden . | |
| 431482 | 10/1977 | Sweden . | |
| 8207473-3 | 7/1983 | Sweden . | |
| 443864 | 3/1986 | Sweden . | |
| 670769 | 6/1979 | U.S.S.R. | 137/504 |
| 2123947 | 2/1984 | United Kingdom . | |
| 2156067 | 10/1985 | United Kingdom . | |

*Primary Examiner*—Stephen Hepperle

*Attorney, Agent, or Firm*—Steinberg & Raskin

[57] ABSTRACT

A constant air flow rate valve with changing cross-section, and having a throttling member disposed within a passage of changing cross-section, the throttling member changing shape depending upon differential pressure across the passage section. The throttling member is also disposed to be displaceable in a direction of a central axis of the passage section, for imposing a set-point value of flow rate. A procedure for controlling the constant air flow rate valve is also provided.

17 Claims, 2 Drawing Sheets

CONSTANT AIR FLOW RATE VALVE, AND PROCEDURE FOR CONTROLLING A CONSTANT AIR FLOW RATE VALVE

BACKGROUND OF THE INVENTION:

The present invention concerns a constant air flow rate valve where, in a flow passage confined by a passage section, has been disposed a throttling member presenting a throttling part which changes shape.

A constant air flow rate valve of this type has been disclosed e.g. in the EP Pat. No. 0027068. Constant air flow rate valves of prior art have an elastic throttling member which has been placed in the interior space of the air passage. When the differential pressure acting across the throttling member increases, the throttling member changes shape so that the flow aperture is reduced. The higher the differential pressure becomes, the smaller becomes the flow aperture similarly, decrease of the differential pressure causes the flow aperture to grow larger. In this way the air flow passing through the constant air flow rate valve is kept approximately constant.

SUMMARY OF THE INVENTION

The object of the invention is to provide an improved constant air flow rate valve in which the known drawbacks of the above-mentioned constant air flow rate valves are avoided, that is, in which within a wide enough differential pressure range is achieved a large enough through-flow in relation to the passage size, and wherein even at high flow velocities the noise level is low, and in said valve the passing air flow rate is controllable to equal a given air flow rate set-point value, and said valve being advantageous in manufacturing.

The constant air flow rate valve of the invention is mainly characterized in that the substantially circular projection of the valve's throttling member on a plane perpendicular against the central axis, has been disposed to grow on its periphery when the differential pressure increases, or to diminish on its periphery when the differential pressure grows less.

The above-mentioned changing of the projection is understood to mean that the throttling portion of the throttling part has been arranged, depending on the differential pressure across the valve, to move radially with its entire mantle surface cross section towards the passage section constituting the flow aperture.

The constant air flow rate valve of the invention is advantageously so designed that said valve passage is a conical structure of which the cross section area decreases linearly in the direction of the longitudinal axis. Now when the throttling member is moved in relation to said valve passage, the distance of the throttling member from the valve passage will be changed at the same time. The substantially circular configuration of the elastic throttling member in the constant air flow rate valve of the invention enables the throttling to take place uniformly over the entire flow cross section area.

The invention also concerns a procedure for controlling the constant air flow rate valve.

The procedure of the invention is in its main parts characterized in that the air flow rate set-point value is input to the constant air flow rate valve by changing the position relative to each other of the elastic throttling part of the constant air flow rate valve's throttling member and the preferably conical passage section of the passage section with variable flow cross section area.

In accordance with the invention a novel constant air flow rate valve controlling method has been implemented wherein set-point adjustment is substantially stepless within a wide flow rate range in such manner that one limit of the flow rate is the fully closed position of the valve, or zero flow condition. The structural design of the constant air flow rate valve of the invention is also very simple and advantageous in view of manufacturing technology. As taught by the invention, adjustment of the set-point value of the constant air flow rate valve is advantageously accomplished in that the throttling member with substantially circular cross section and made of an elastic material is moved in relation to the valve passage in the direction of the longitudinal axis of the valve passage.

BRIEF DESCRIPTION OF THE DRAWINGS

The invention is described in the following, referring to the figures that have been enclosed.

DESCRIPTION OF THE PREFERRED EMBODIMENTS

Figure 1:
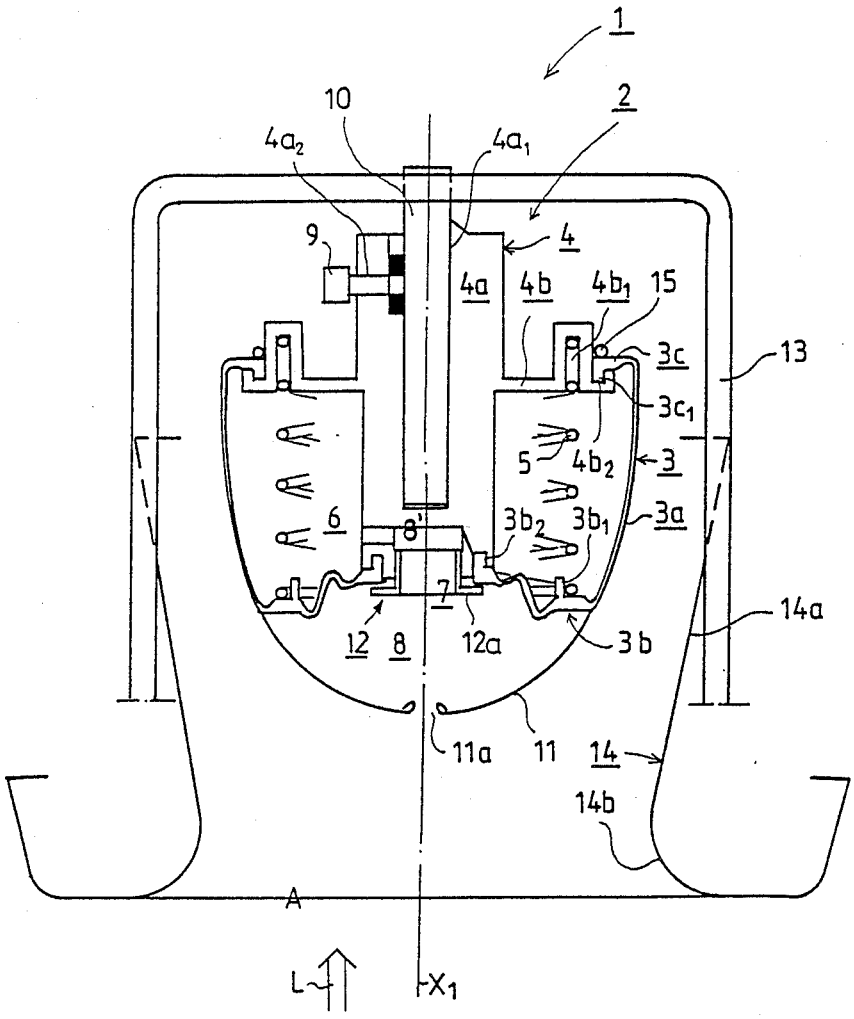
In FIG. 1 is depicted a constant air flow rate valve according to the invention, in elevational sectioned view, the spring of the constant air flow rate valve having been schematically indicated in this figure.

In FIG. 1 is indicated with reference numeral 1, the constant air flow rate valve of the invention. The constant air flow rate valve 1 comprises a throttling member, which has been indicated with the general reference numeral 2. The throttling member 2 comprises a throttling part 3 made of an elastic material, preferably of silicone. The throttling part 3 has a flow-throttling portion **3*a*, and at its ends a first end portion 3*b* and at the other end a second end portion 3*c*. The first end portion 3*b* carries a spring fixing shoulder or another equivalent spring fixing part $3b_1$, and on the same end is also located the first fixing border $3b_2$ for the throttling part 3. In the other end portion 3*c* is located the second fixing border $3c_1$ for the throttling part 3**.

The throttling member 2 comprises a body part 4, consisting of a main body **4*a* and a fixing disk 4*b* attaching thereto substantially in its central area. The fixing disk 4*b* carries fixing means $4_1$ for the end of the spring, these being preferably formed by cavities in which one end of the spring can be placed and in which the spring is thus firmly held. The fixing disk 4*b* also comprises a second fixing border $3c_1$ for the throttling part 3, fixing means $4_2$, likewise preferably formed by a cavity, the second border $3c_1$ of the throttling part 3** being placeable and fixable in this cavity.

The main body **4*a* is advantageously an elongated, cylindrical body part having on its central axis an elongated threaded hole $4a_1$, closed at one end, for the shaft 10. The threads provided on the shaft 10 and in the threaded hole $4a_1$ in the body 4 are compatible as to their thread systems so that the body 4 can be rotated on the shaft 10** in the direction of the central axis $X_1$.

The shaft 10 is located substantially on the central axis $X_1$ of the passage section 14. Shaft 10 may also comprise splines or other equivalent elements for displacement of the throttling member 2.

The body 4 has also been provided with a threaded hole $4a_2$ for the set-point value locking screw 9. This enables the throttling member 2 to be locked in a given position on the shaft 10.

Between the throttling part 3 and the body 4 remains an expansion chamber 6, in this chamber being accommodated a spring 5, preferably a compression spring. The chamber 6 communicates by an air aperture 7 with the entrance chamber 8 and, further, through the central aperture 11*a* in the flow deflector part 11 with the air space on the incoming air flow side of the throttling member 2. Said air communication has expressly been provided to enable air to flow through the apertures 11*a* and 7 into the expansion chamber 6 when the throttling part 3 changes shape.

The shaft 10 has expressly been provided for set-point fixing. The throttling member 2 can be displaced in the direction of the central axis of the shaft 10 to assume the position on the shaft 10 which is desired in each particular instance and, thereby, the desired position in relation to the passage structures of the valve. The air flow deflector part 11 has been attached to the throttling part 3 in the region between the throttling portion 3*a* and the first end portion 3*b*. The flow deflector part 11 is a part with curved surface and its effect is, by its curvature, to deflect the flow smoothly to pass along the flow path defined between the throttling part 3 and the passage. The flow deflector part 11 has a central air aperture 11*a*, through which air is enabled to flow into the chamber 8 and, further, through the air aperture 7 into the equalizing chamber 6, or vice versa, depending on whether the throttling of the air flow is being increased or reduced, i.e., whether the chamber 6 expands or contracts.

The locking part 12 is located at one very end of the body 4a. It is possible by means of the locking part 12 to ensure the holding of the first fixing border $3b_2$ of the throttling part in contiguity with the body proper, 4. The fixing part 12 is provided with a central flow aperture, and it has on one end a shoulder 12a which urges the fixing border $3b_2$ of the throttling part 3 into the cavity in the main body 4*a* and holds it there.

The shaft 10 is attached to a yoke part 13, which is further fixedly positioned in relation to the valve passage 14. The valve is provided with a set-point scale, this scale being advantageously marked on the shaft 10.

The valve passage 14 is most advantageously a conical body. The passage section 14 has a flow surface 14*a* obliquely positioned in relation to the central axis $X_1$. The passage section 14 flares out conically. Its flow cross section is substantially circular, and consequently the central axis $X_1$ is, at the same time, the axis of symmetry for the passage section. To the flow section 14*a* adjoins a curved intake section 14*b*. The flow, when entering the valve as indicated by arrow L, encounters the throttling part 2 and its flow deflector part 11, which deflects the flow to the flow path defined between the passage 14 and the throttling part 2.

The spring 5 is fitted with one end to the throttling part 3 and with its other end to the fixing disk 4*b* on the body 4 of the throttling member 2, in its spring end fixing means $4_1$, which preferably consist of cavities. On the other end, the spring 5 is attached to the throttling part 3 itself, to its first end portion 3*b*. It is fixed on said first end portion 3*b* with the aid of a spring fixing shoulder $3b_1$ or equivalent.

In the constant air flow rate valve controlling procedure of the invention, the valve is adjusted to pass an air flow of given magnitude, independent of the differential pressures, by setting the throttling member 2 in a given position on the central axis $X_1$ of the passage section 14. Since the passage section 14 expands in conical fashion, it is obvious that when the throttling member 2 is displaced in the direction of the central axis $X_1$ the throttling member 2 can always be made to be located at desired distance from the flow surface 14*a* disposed obliquely in relation to the central axis $X_1$ of the passage section 14. When the throttling member 2 is positioned in the close vicinity of the curved part 14*b* of the passage section 14, the throttling regions of the throttling part 3 of throttling member 2 are located very close to the flow surface 14*a* of the passage section 14. In this case a set-point has been imposed at which the least possible air flow is admitted to pass through the valve. When, on the other hand, the throttling member 2 is located as far away as possible from the intake aperture A through which the air enters the valve, the throttling part 3 of throttling member 2 is located as far as possible from the flow surface 14*a* of the passage section 14, and the greatest possible flow is admitted through the valve. It is thus understood that, by positioning the throttling member 2 in a given position on the central axis $X_1$, one at the same time positions said throttling member 2 at a given distance from the flow surface 14*a* of the passage section 14. Thus, setting of the set-point is accomplished by moving the throttling member 2 along the $X_1$ axis in relation to the passage section 14, which is conical. This displacement may be accomplished by rotating the throttling member 2 on the threads of the shaft 10 so that the throttling member 2 is displaced on the axis $X_1$. When a given flow rate set-point has been attained, the screw 9, or equivalent, may be turned to secure the position of the throttling member 2 on the shaft 10. The shaft 10 is in this case fixedly carried in the yoke 13, this yoke 13 further being fixedly located in relation to the passage section 14. It is clear that the control procedure may equally be implemented in such manner that the shaft 10 is fixedly attached to the throttling member 2, the throttling member 2 together with the shaft 10 then being rotated in threads provided in the yoke 13.

Alternatively the setting of the set-point may be accomplished by merely moving the throttling member to axially in the direction of the axis $X_1$.

Figure 2:
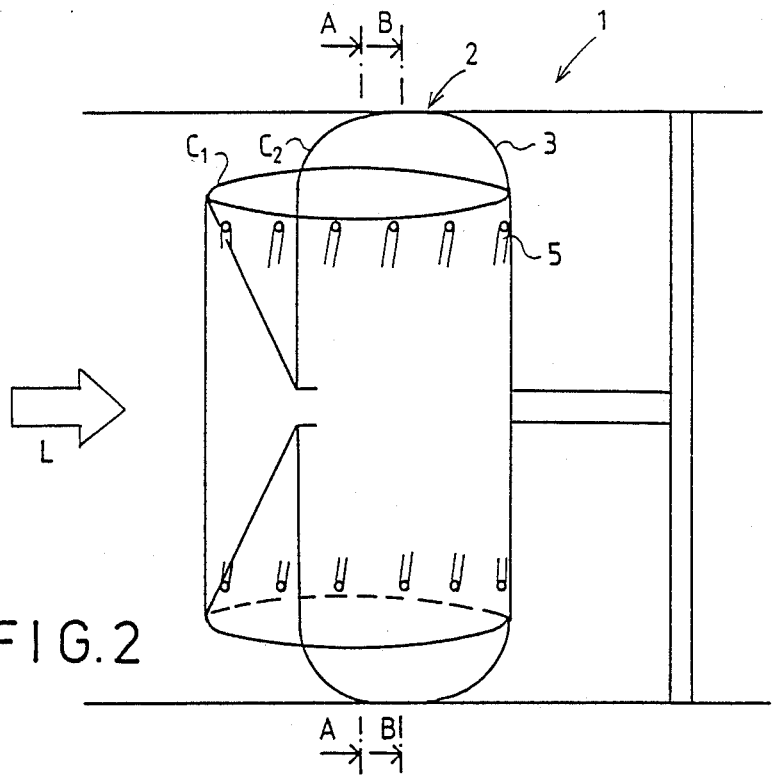
In FIG. 2 are illustrated the two extreme positions of the constant air flow rate valve of the invention, these positions being indicated with symbols $C_1$ and $C_2$, respectively.

In FIG. 2, two extreme shapes of the throttling part 3 with which the flow aperture is at its largest. $C_2$, again, indicates in this figure that shape of the throttling part 3 with which the flow aperture is smallest.

Figure 3:
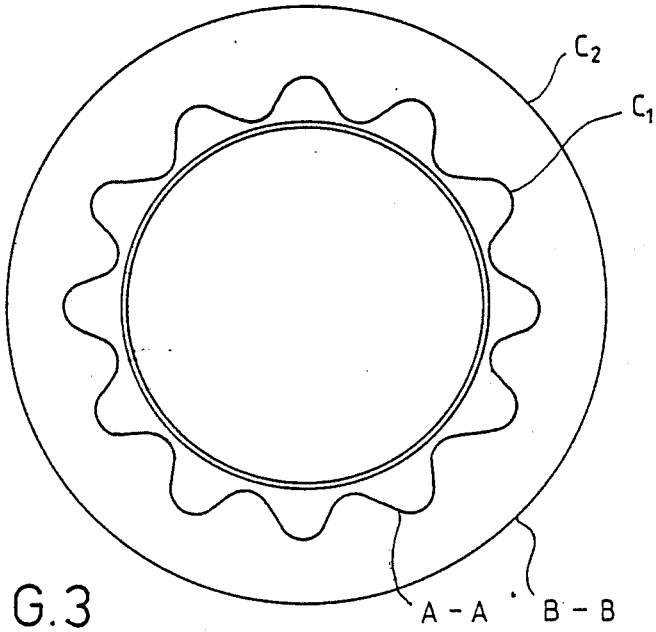
In FIG. 3 are shown said extreme positions $C_1$ and $C_2$ of FIG. 2 along the section lines A—A and B—B, whereof the section plane A-A represents one extreme position $C_1$ and section plane B—B represents the other extreme position $C_2$.

FIG. 3 illustrates these two extreme shapes of the throttling part 3, in cross section and shown as sectioned along the lines A-A and B—B in FIG. 2. When the throttling part 3 is in the state in which the maximum flow aperture is provided, the throttling portion wall of the throttling part 3 is pleated in undulating fashion (section A—A). This wavy shape enables the throttling part 3 to expand towards the flow surface 14*a* of the passage section 14. $C_2$ in FIG. 3 indicates this throttling part 3 when fully expanded, in which case the cross section shape is circular (section B-B). The crests and dales of the waves occurring here run parallel to the central axis $X_1$.

Imposing of the air flow rate set-point value is accomplished by increasing or reducing distance between the entire cross-section area of a mantle of the throttling part 3 and the passage section 14.

In an advantageous embodiment of the invention, the shaft 10 is a guide with rectangular cross section, on which the throttling member 2 can be secured in various positions with the aid of a locking screw or equivalent. The guide carries on one face a scale for different flow rate settings.

The chamber 8 serves as damping means preventing resonance vibrations of the throttling part 3. In an advantageous embodiment of the invention, a wide chamber space has been established at the point 8' in the body part 4a of the throttling member 2, communication being provided therefrom to the space on the incoming flow side, and one or several air apertures to the equalizing space 6. The respective chamber in the body part 4a will then operate as highly effective resonance damping means, and no anterior chamber 8 is then needed in this embodiment.

I claim:

1. A constant gas flow rate valve with a throttling member disposed in a flow passage defined by a passage section, said throttling member comprising a throttling part changing shape under effect of differential pressure acting across said valve, and a projection of said throttling part arranged to grow and to become smaller according to changes in the differential pressure, wherein in a plane substantially perpendicular to a central axis of the passage section, said projection has been arranged to grow in its entire periphery when the differential pressure increases and to become smaller in its entire periphery when the differential pressure decreases, and said throttling part has a wavy structure in which crests and troughs of said waves run substantially parallel to the central axis, wherein said throttling member additionally comprises a main portion, fixing means attached to said main portion and extending radially outwardly therefrom, with said throttling part being mounted upon said fixing means, and spring means being mounted, at one end thereof, upon said fixing means, and at an opposite end thereof upon said throttling part.

2. The combination of claim 1, wherein the passage section has a changing cross-section.

3. The combination of claim 2, wherein the passage section has a substantially conical cross-section.

4. The combination of claim 1, wherein said throttling member is mounted within the passage for movement substantially in the direction of the central axis, for imposing a flow rate set-point value.

5. The combination of claim 1, wherein said valve additionally comprises a shaft disposed to be fixedly positioned within the passage section, with said throttling member being mounted on said shaft for displacement thereabout or therealong.

6. The combination of claim 1, additionally comprising a shaft on which said main portion of said throttling member is mounted for adjustment.

7. The combination of claim 1, wherein said throttling member and throttling part define an expansion chamber therebetween, in which said spring means are situated.

8. The combination of claim 5, wherein said shaft additionally comprises threads or splines on one end thereof, for displacement of said throttling member in the direction of the central axis.

9. The combination of claim 1, wherein said throttling member additionally comprises, on a surface thereof facing incoming flow in the passage section, a flow deflector part having a curved surface and at least one aperture in said flow deflector part for admitting gas into a chamber within said throttling member.

10. The combination of claim 7, additionally comprising a flow deflector having a curved surface to deflect flow between said throttling part and a wall of the passage section, and being mounted upon said throttling part in the direction of incoming gas flow, said flow deflector and said throttling part defining an entrance chamber therebetween, said flow deflector comprising a substantially central aperture for admitting gas into said entrance chamber, and further comprising an interior aperture through which said expansion and entrance chambers communicate.

11. The combination of claim 5, wherein said shaft is located substantially along the central axis of the passage section.

12. The combination of claim 10, additionally comprising a locking portion situated on said main portion at an end away from said fixing disc and having shoulder for urging an end of said throttling part opposite an end thereof mounted on said fixing disc, into contact with said main portion.

13. The combination of claim 11, additionally comprising a yoke fixedly positioned within the passage section and on which said shaft is mounted.

14. The combination of claim 6, wherein said main portion additionally comprises a radially extending, threaded hole, and additionally comprising a set-point locking screw for locking said throttle member into position upon said shaft through said hole.

15. The combination of claim 1, wherein said throttling part projection assumes said wavy structure in one extreme position, and assumes a shape of substantially circular cross-section in another extreme position.

16. The combination of claim 1, wherein said wavy structure comprises a series of crests and troughs extending around said throttling projection and at a distance away from a wall of the passage section.

17. The combination of claim 1, wherein said fixing means comprise a fixing disc.

* * * * *